US005931899A

United States Patent [19]

Kertis

[11] Patent Number: 5,931,899

[45] Date of Patent: Aug. 3, 1999

[54] METHOD AND APPARATUS FOR PROVIDING ANALOG DIFFERENTIAL SIGNAL MULTIPLICATION WITH A SUBSTANTIALLY LINEAR RESPONSE OVER A RELATIVELY LARGE RANGE OF MULTIPLICATION

[75] Inventor: Robert A. Kertis, Rochester, Minn.

[73] Assignee: International Business Machines Corporation, Armonk, N.Y.

[21] Appl. No.: 08/807,390

[22] Filed: Feb. 27, 1997

[51] Int. Cl.[6] ..... G06G 7/16

[52] U.S. Cl. ..... 708/835; 327/359

[58] Field of Search ..... 364/841; 327/359; 330/252

[56] References Cited

U.S. PATENT DOCUMENTS

| | | | |
|---|---|---|---|
| Re. 30,572 | 4/1981 | Steckler | 330/252 |
| 3,848,139 | 11/1974 | Holt, Jr. | 307/235 |
| 4,081,758 | 3/1978 | Steckler | 330/252 |
| 4,586,155 | 4/1986 | Gilbert | 364/841 |
| 4,634,994 | 1/1987 | Wilhelm | 330/260 |
| 4,694,204 | 9/1987 | Nishijima et al. | 327/359 |
| 4,820,997 | 4/1989 | Sano et al. | 330/252 |
| 5,184,086 | 2/1993 | Inohana et al. | 330/252 |

*Primary Examiner*—Tan V. Mai

*Attorney, Agent, or Firm*—Brian F. Russell; Andrew J. Dillon

[57] ABSTRACT

A signal multiplier is provided for use in multiplying an analog differential signal. The analog differential signal is defined by a first analog attribute and a second analog attribute. Preferably, a means is provided for generating a first current which corresponds to the first analog attribute. Additionally, a means is provided for generating a second current which corresponds to the second analog attribute. A first amplifier member is provided for receiving the first current as an input and providing as an output a multiple of the first current. Additionally, a second amplifier is provided for receiving the second current as an input and producing as an output a multiple of the second current. A tuneable multiplier member is provided for determining the multiple over a predetermined range of multiples. A means for maintaining a substantially linear response of the signal multiplier is also provided. The means for maintaining the substantially linear response of the multiplier provides at least approximately two orders of magnitude in multiplication. The means for maintaining a substantially linear response of the signal multiplier includes a means for utilizing base current cancellation in order to minimize the influence of particular base currents from particular analog circuit components which would otherwise limit the linear response of the analog signal multiplier of the present invention.

16 Claims, 6 Drawing Sheets

METHOD AND APPARATUS FOR PROVIDING ANALOG DIFFERENTIAL SIGNAL MULTIPLICATION WITH A SUBSTANTIALLY LINEAR RESPONSE OVER A RELATIVELY LARGE RANGE OF MULTIPLICATION

BACKGROUND OF THE INVENTION

1. Field of the Invention

The present invention relates in general to analog signal multiplication, and in particular to analog signal multiplication of a differential analog signal.

2. Description of the Prior Art

In data processing and digital signal processing applications, analog signals are processed in a manner which requires that a differential analog signal be multiplied by a multiplier which has a variable magnitude. One example of such an application is a Finite Impulse Response Filter, such as those used in channel communication chips incorporated into disk drives and modems. In those applications, a sampled analog differential signal is multiplied by a weighing factor which is of variable magnitude over a predetermined range. In most applications, it is desirable to have the multiplication operate in a linear manner.

SUMMARY OF THE INVENTION

It is one objective of the present invention to provide a signal multiplier which may be utilized to multiply an analog differential signal, which is defined by a first analog attribute and a second analog attribute, in a manner which has accuracy comparable to, or greater than, the prior art digital signal multipliers, but which uses much less power than the prior art digital signal multipliers, and with fewer operating components, thus utilizing less surface area in a silicon product than previously found in the digital signal multipliers of the prior art.

It is yet another objective of the present invention to provide a signal multiplier for use in multiplying an analog differential signal defined by a first analog attribute and a second analog attribute and which is composed of analog circuit components, as opposed to digital circuit components.

It is still another objective of the present invention to provide a signal multiplier for use in multiplying an analog differential signal defined by a first analog attribute and a second analog attribute, which provides for a linear response over a relatively wide range of multiplication, preferably substantially two orders of magnitude of multiplication. In accordance with the present invention, the linearity of the analog signal multiplier of the present invention is maintained by utilizing a base current cancellation technique to cancel particular base currents in the device which would otherwise significantly limit the linearity of the signal multiplier.

These and other objectives are achieved as is now described. In accordance with the present invention, a signal multiplier is provided for use in multiplying an analog differential signal. Preferably, the analog differential signal is defined by a first analog attribute and a second analog attribute. Preferably, a means is provided for generating a first current which corresponds to the first analog attribute. Additionally, a means is provided for generating a second current which corresponds to the second analog attribute. A first amplifier member is provided for receiving the first current as an input and providing as an output a multiple of the first current. Additionally, a second amplifier is provided for receiving the second current as an input and producing as an output a multiple of the second current. A tuneable multiplier member is provided for determining the multiple over a predetermined range of multiples. A means for maintaining a substantially linear response of the signal multiplier is also provided. In accordance with the present invention, the means for maintaining the substantially linear response of the multiplier provides at least approximately two orders of magnitude in multiplication range. In the particular preferred embodiment discussed herein, the means for maintaining a substantially linear response of the signal multiplier includes a means for utilizing base current cancellation in order to minimize the influence of particular base currents from particular analog circuit components which would otherwise limit the linear response of the analog signal multiplier of the present invention.

DETAILED DESCRIPTION OF THE DRAWINGS

Figure 1:
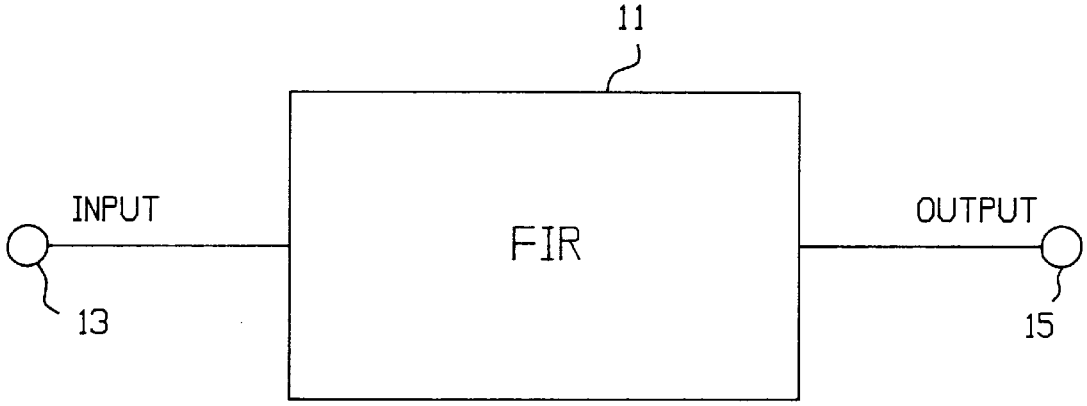
FIG. 1 PRIOR ART
FIG. 1 is a block diagram representation of a Finite Impulse Response Filter, in accordance with the prior art.

FIG. 1 is a block diagram depiction of a prior art Finite Impulse Response Filter ("FIR") 11 which receives an input 13 and produces an output 15.

Figure 2:
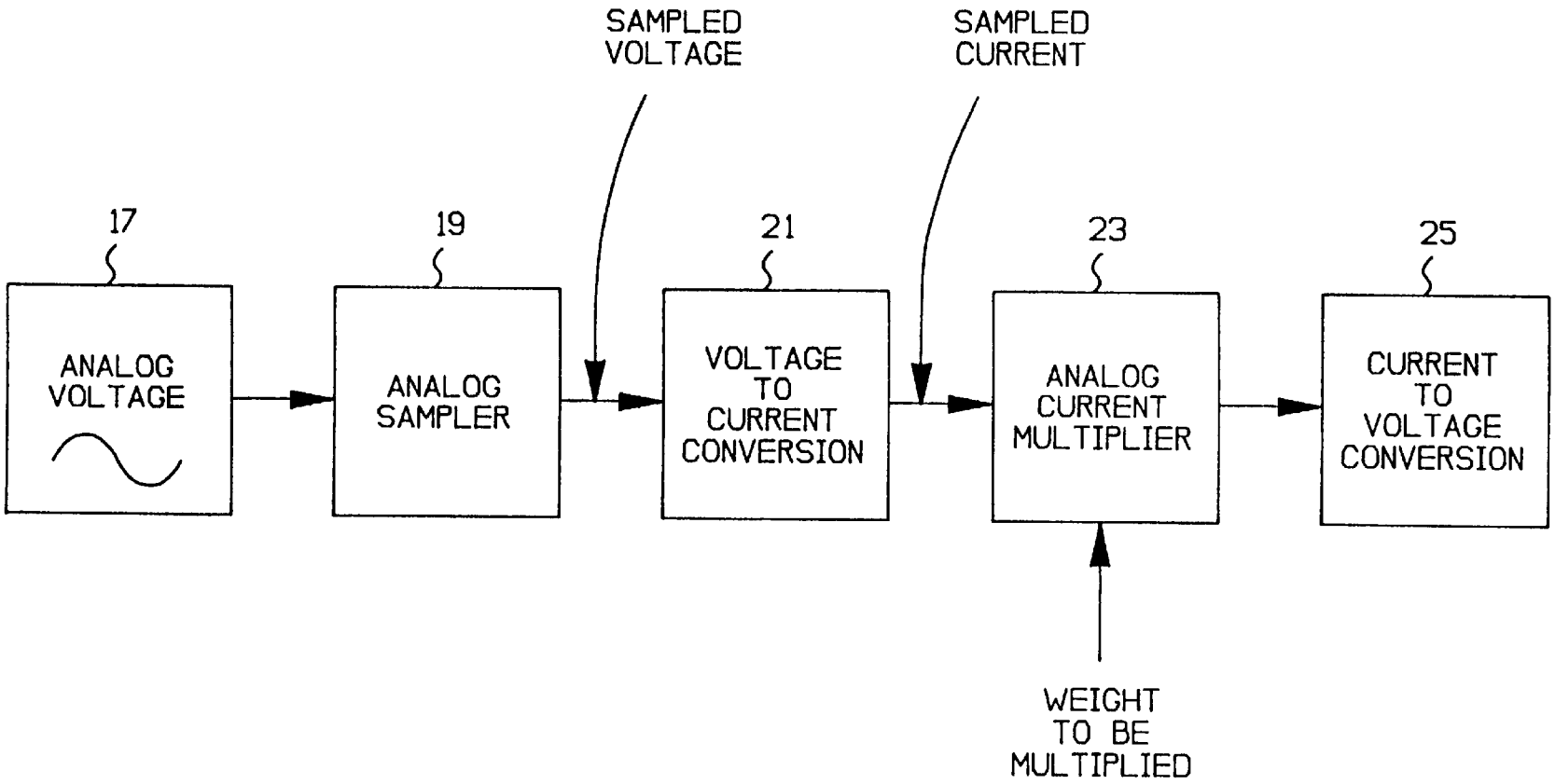
FIG. 2 PRIOR ART
FIG. 2 is a block diagram depiction of a sub-assembly of the Finite Impulse Response Filter of FIG. 1, also in accordance with the prior art.

FIG. 2 is a simplified block diagram depiction of the operation of one sub-assembly of FIR 11. As is shown, analog voltage 17 is sampled by a sample-and-hold circuit 19. The sampled analog voltage 19 is converted to a sampling analog current by the converter 21. The sampled analog current is supplied to an analog multiplier 23, which applies the variable multiplication. The weighted (or multiplied) current is converted back to voltage by module 25. The process depicted in FIG. 2 is greatly simplified and is, in fact, typically under the control of a processing unit.

The First Embodiment

Figure 3:
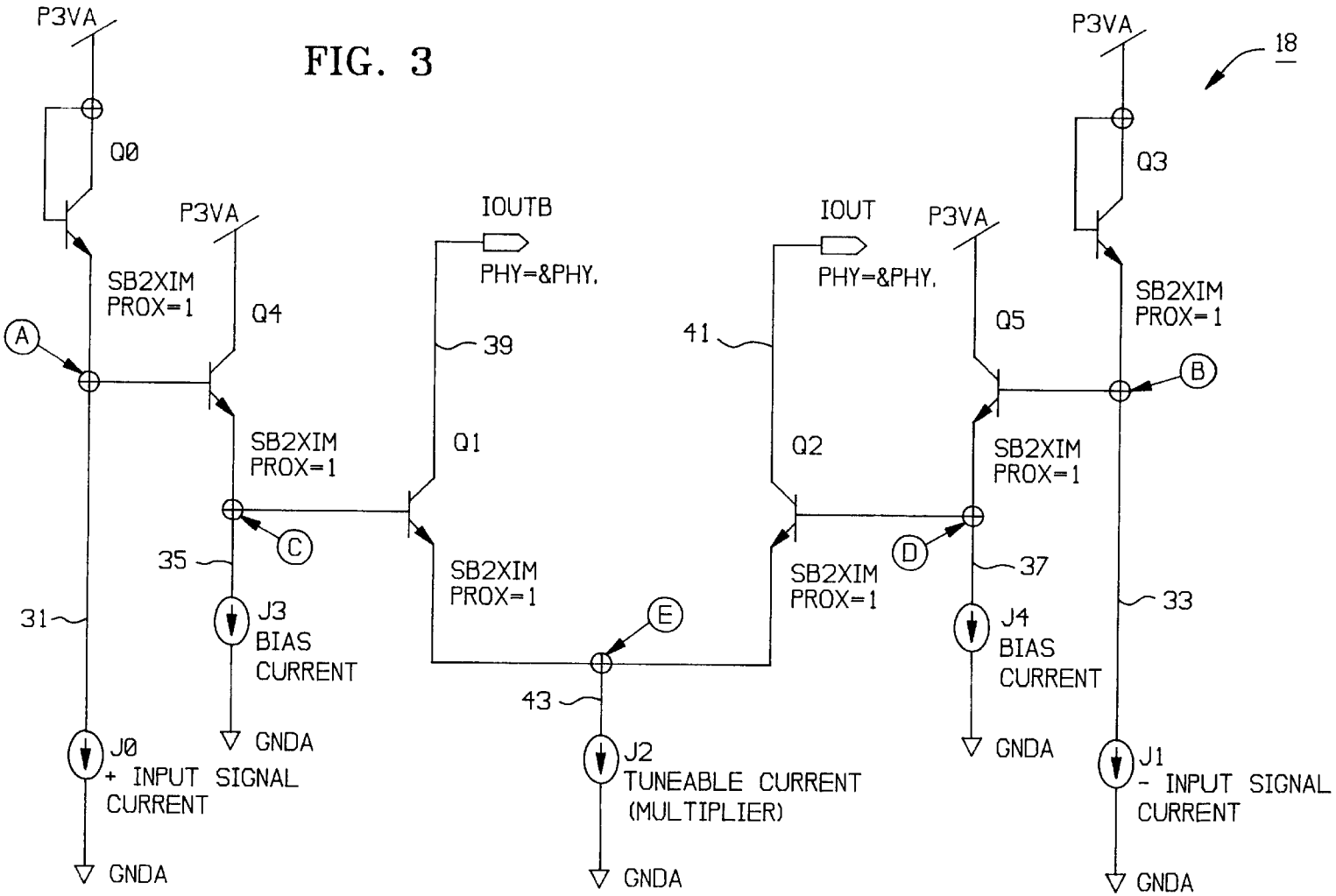
FIG. 3 is a circuit diagram of one embodiment of the analog differential signal multiplier of the present invention.

FIG. 3 is an electrical schematic depiction of one analog differential signal multiplier 18 in accordance with the present invention. In accordance with the present invention, an analog differential signal is supplied to the circuit of FIG. 3 through operation of current source J0 and current source J1. In accordance with the convention of the prior art, a differential voltage is converted to current through operation of current sources J0, J1. Current source J0 determines the current flowing in pathway 31, while current source J1 determines the current flowing in pathway 33. Current pathway 31 also includes transistor Q0, which is in a diode configuration. Likewise, current pathway 33 includes transistor Q3, which is also in a diode configuration.

As is shown in FIG. 3, the emitter of transistor Q0 is coupled to the base of transistor Q4 at node A. Likewise, the emitter of transistor Q3 is coupled to the base of transistor Q5 at node B. In accordance with the present invention, transistor Q4 and transistor Q5 are matching transistors and are substantially identical in all significant attributes. Transistor Q4 is coupled in current pathway 35. Current source J3 is included in current pathway 35 and supplies a bias current. Likewise, transistor Q5 is coupled in current pathway 37. Current source J4 is included in current pathway 37 and provides a bias current thereto. The emitter of transistor Q4 is coupled to the base of transistor Q1 at node C in an emitter-follower configuration. Likewise, the emitter of transistor Q5 is coupled to the base of transistor Q2 at node D, also in an emitter-follower configuration. In accordance with the present invention, transistors Q1 and Q2 are matched transistors, so that all attributes are identical.

As is depicted in FIG. 3, transistor Q1 is coupled in current pathway 39. Likewise, transistor Q2 is coupled in current pathway 41. Current pathway 43 is coupled to current pathways 39 and 41, at node E. Current source J2 is coupled to current pathway 43, and comprises a tuneable current source. In accordance with the present invention, the tuneable current of current source J2 serves as the multiplier. The multiplier can be adjusted over a predetermined range in order to multiply the analog differential signal represented by the current of current source J0 in current pathway 31 and the current of current source J1 in current pathway 33. In accordance with the present invention, the bias currents of current sources J3 and J4 are identical currents.

In accordance with the present invention, the current J2 which flows through current pathway 43 is equal to the current flowing through transistor Q1 (I-OUT-B) plus the current flowing through transistor Q2 (I-OUT). The objective of the present invention is for the ratio of the currents I-OUT and I-OUT-B to be equal to the ratio of the currents J0 and J1, as set forth in the following equation:

$$I\text{-}OUT/I\text{-}OUT\text{-}B=J0/J1$$

As the current J2 is increased, the base currents in transistors Q1 and Q2 introduce significant error components. This can be demonstrated by three examples.

EXAMPLE NO. 1

The first example is the situation wherein the current of current magnitude source J0 equals the current magnitude of current source J1. Assume also that J3 equals 100 microamps, J4 equals 100 microamps, and J2 equals 100 microamps. In this situation, the voltage at node A is equal to the voltage at node B. Likewise, the voltage at node C is equal to the voltage at node D. Assuming the Beta of transistors Q1 and Q2 is 50, then the base current at transistor Q1 is 1 microamp, and the base current at transistor Q2 is also 1 microamp. The current flowing through transistor Q4 is equal to 101 microamps. Likewise, the current flowing through transistor Q5 is equal to 101 microamps. Note that the circuit is balanced, and there is no significant error component due to base currents.

EXAMPLE NO. 2

Turning now to the second example, assume that the current of current source J0 is twice that of the current of current source J1. In this instance, the voltage at node A is less than the voltage at node B, and the voltage at node C is less than the voltage at node D. If the current J2 is set to 100 microamps, then the current passing through transistor Q2 is 66.6 microamps, while the current passing through transistor Q1 is 33.3 microamps. In this situation, the base current of transistor Q2 will be 1.33 microamps (as compared to the previous example of 1 microamp) and the base current of transistor Q1 will be 0.66 microamps (as compared to the current of 1 microamp). Accordingly, the current passing through transistor Q5 will be 101.33 microamps (as compared to 101 microamps), while the current passing through transistor Q4 will be 100.66 microamps (as compared to 101 microamps). Still, the difference is quite small, so it is fair to conclude that the ability to transfer the voltage at node B to node D, and from node A to node C, is quite good for a one order of magnitude multiplication.

EXAMPLE NO. 3

Let us turn now to a third example, in which the current magnitude of current source J2 is much greater than that of the previous example. For this third example, assume that the current magnitude of current source J2 is 1 milliamp. If the current magnitude of current sources J0 and J1 are equal, assuming there is no error component, we would expect to find 500 microamps from I-OUT and 500 microamps from I-OUT-B. Such an increase in the magnitude of current source J2 will cause the base current in transistors Q1 and Q2 to go from 1 microamp to 10 microamps, for a balanced signal, with no differential signal applied. However, if there is a 2-to-1 difference in the currents of J0 and J1, the current flowing through transistor Q2 will be 666 microamps, while the current flowing through transistor Q1 will be 333 microamps. In this scenario, the base current of transistor Q2 will be 13.3 microamps, while the base current of transistor Q1 will be 6.6 microamps. This results in a current flowing from the emitter of transistor Q4 of 106.6 microamps, and a current flowing from the emitter of transistor Q5 of 113.3 microamps. Thus, the base-emitter voltage ($V_{BE}$) of transistor Q5 is determined by 113.3 microamps, and the base-emitter voltage ($V_{BE}$) of transistor Q4 is determined by 106.6 microamps.

As can be seen, as the magnitude of the current from current source J2 increases, when there is a differential signal present, the base-emitter voltages ($V_{BE}$) of Q4 and Q5 start adding a significant error component. It is desirable to have high Betas for these transistors or to maintain the base current at a small amount. In the preferred embodiment of the present invention, the Beta of transistors Q4 and Q5 should be in the range of 40–250 after silicone manufacturing. One would experience problems at a lower Beta.

The circuit depicted in FIG. 3 can maintain a linear response easily over 1 order of magnitude of multiplication. However, the circuit becomes non-linear as the multiplication increases toward 2 orders of magnitude (specifically, the linearity of response diminishes at multiplication of the range of 80–90).

The Second Embodiment

Figure 4:
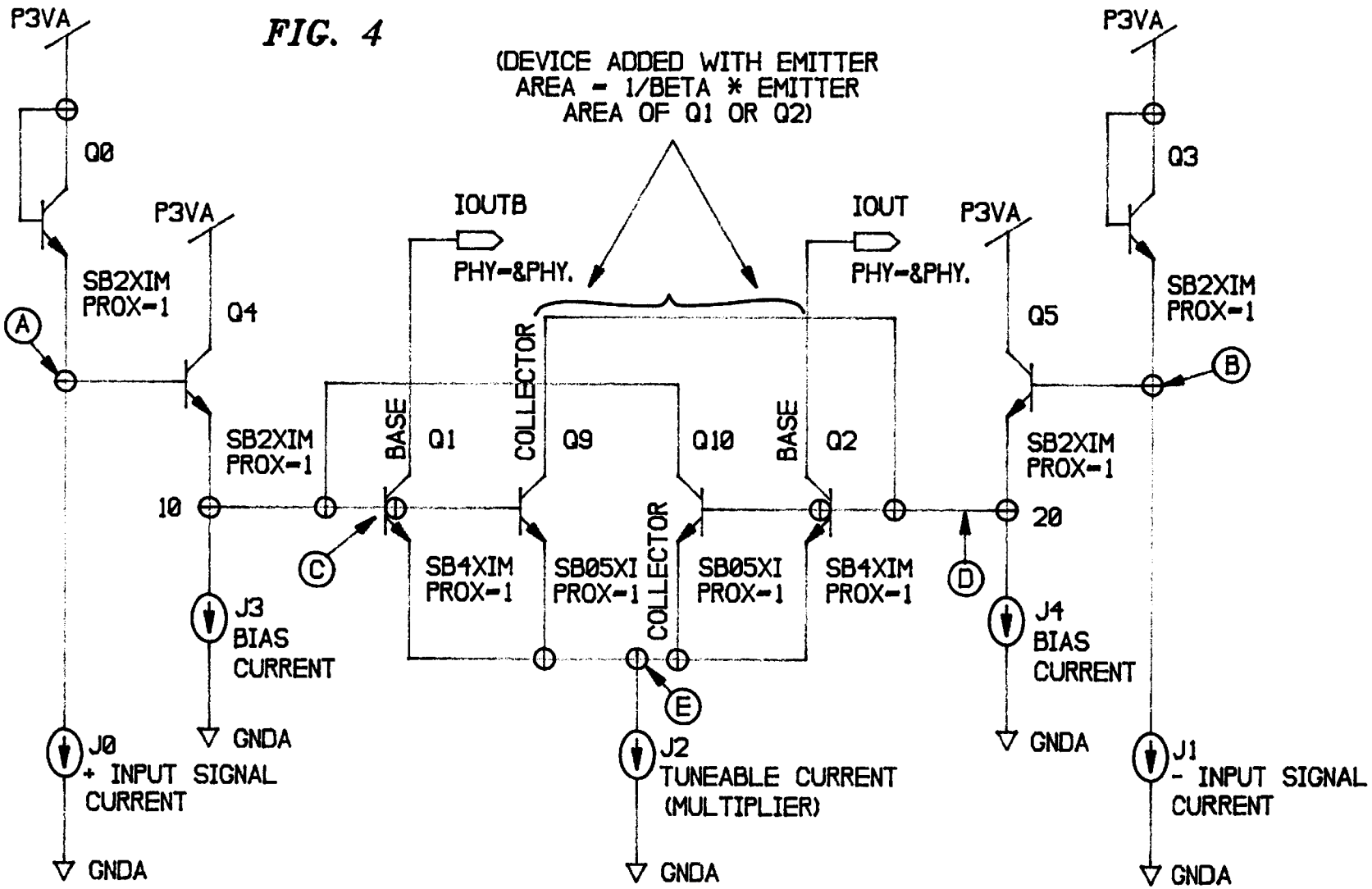
FIG. 4 is a circuit diagram of a second embodiment of the analog differential signal multiplier of the present invention.

FIG. 4 is a circuit depiction of another embodiment of the present invention which maintains a linear response over a greater range of multiplication. This is accomplished by the addition of transistors Q9 and Q10 to the circuit of FIG. 3, as is depicted in FIG. 4. As is shown, transistor Q10 has its collector connected to the base of transistor Q1, and its emitter connected to node E. Transistor Q9 has its collector connected to the base of transistor Q2, and its emitter connected to the node E. The emitter areas of transistors Q9 and Q10 are much smaller in size than transistors Q1 and Q2. In the preferred embodiment of the present invention, which is a semiconductor implementation, the emitter areas of transistors Q9, Q10, are about 2% of the size of transistors Q1 and Q2. This limits the current that is added back by transistors Q9, Q10, since the current through transistors Q9, Q10, is proportionate to the emitter area of those transistors. Essentially, a current term is added to nodes C and D which moves in the opposite direction of the base currents of Q1 and Q2 in order to cancel (through base current cancellation) the error introduced by the base currents as discussed above in connection with FIG. 3.

The goals of the implementation of FIG. 4 are to have the following:

(1) the sum of the current of the base of transistor Q1, the current of the collector of transistor Q10, and the current of current sours J3, are to be equal to a constant independent of differential signal currents provided by input current J0 to J1; and (2) the sum of the current of the base of transistor Q2, the current of the collector of transistor Q9, and the current of current source J4, are to be equal to a constant independent of differential signal currents provided by input currents J0 and J1.

Figure 5:
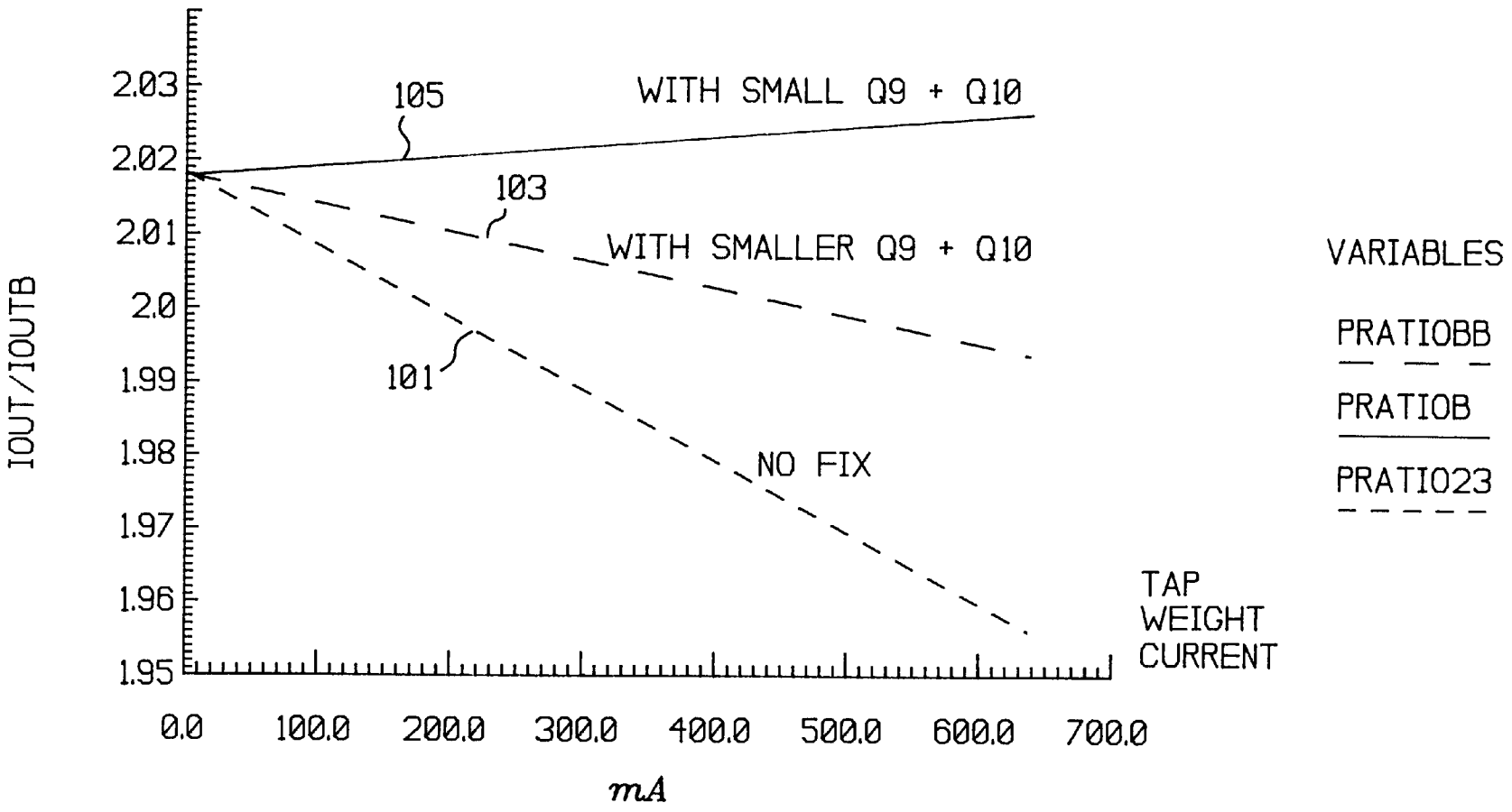
FIG. 5 is a graphical depiction of the ratio of I-OUT and I-OUT-B as a function of the tuneable (multiplier) current in microamps with the ratio of J1 to J0 equal to 2.
Figure 6:
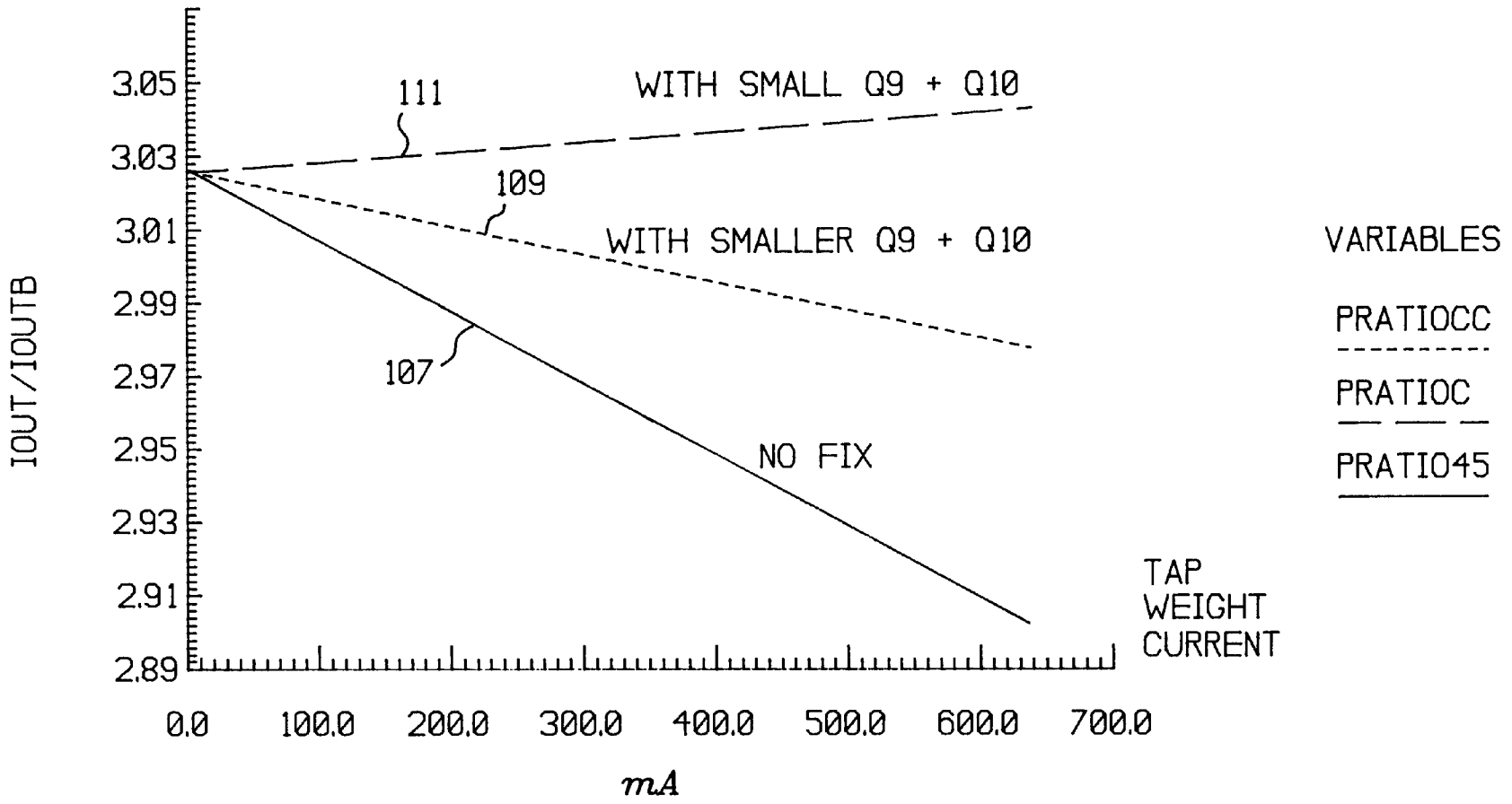
FIG. 6 is a graphical representation of the ratio of I-OUT and I-OUT-B as a function of the tuneable (multiplier) current in microamps with the ratio of J1 to J0 equal to 3.

The beneficial effect of this base current cancellation is graphically depicted in FIGS. 5 and 6. Turning first to FIG. 5, there is depicted a graph of the ratio of I-OUT to I-OUT-B as the magnitude of current source J2 is increased from 0 microamps to 700 microamps. For this figure the ratio of J1 to J0 is equal to 2. Three curves are presented. Curve 101 depicts the response of the analog differential signal multiplier of the present invention with no base current cancellation. Curve 105 represents the output of the analog differential signal multiplication current of the present invention with a small amount of base current cancellation through operation of transistors Q9 and Q10, while curve 103 depicts a smaller amount of base current cancellation due to operation of smaller transistors Q9 and Q10. Note that the size of transistors Q9 and Q10 can determine the amount of correction through base current cancellation. An optimum transistor size can be determined through empirical testing of the various transistor sizes. Note that the response of curve 105 is substantially linear over a broad range of multiplication, and provides a more accurate analog differential signal multiplication device as opposed to the response curves of curve 101 and curve 103.

Turning first to FIG. 6, there is depicted a graph of the ratio of I-OUT to I-OUT-B as the magnitude of current source J2 is increased from 0 microamps to 700 microamps. For this figure, the ratio of J1 to J0 is equal to 3 as opposed to the previous graph (which was for a ratio of 2). Three curves are presented. Curve 107 depicts the response of the analog differential signal multiplier of the present invention with no base current cancellation. Curve 111 represents the output of the analog differential signal multiplication current of the present invention with a small amount of base current cancellation through operation of transistors Q9 and Q10, while curve 109 depicts a smaller amount of base current cancellation due to operation of smaller transistors Q9 and Q10. Note that the size of transistors Q9 and Q10 can determine the amount of correction through base current cancellation. An optimum transistor size can be determined through empirical testing of the various transistor sizes. Note that the response of curve 111 is substantially linear over a broad range of multiplication, and provides a more accurate analog differential signal multiplication device as opposed to the response curves of curve 101 and curve 103. A comparison of FIGS. 5 and 6 reveal that a linear response can be maintained over a relatively broad range of differential signals.

What is claimed is:

1. A signal multiplier for use in multiplying an analog differential signal defined by a first analog attribute and second analog attribute, comprising:

means for providing a first current corresponding to said first analog attribute;

means for providing a second current corresponding to said second analog attribute;

a first amplifier member for receiving said first current as an input and producing as an output a multiple of said first current;

a second amplifier member for receiving said second current as an input and producing as an output a multiple of said second current;

a tuneable multiplier member for determining said multiple over a predetermined range of multiples; and means for maintaining a substantially linear and substantially amplified response of said signal multiplier.

2. A signal multiplier according to claim 1 wherein said means for maintaining substantially linear response comprises:

means for maintaining substantially linear response of said signal multiplier of at least approximately two orders of magnitude in multiplication.

3. A signal multiplier according to claim 1 wherein said means for providing a first current comprises:

means for providing a first current corresponding to a first voltage level.

4. A signal multiplier according to claim 1 wherein said means for providing a second current comprises:

means for providing a second current corresponding to a second voltage level.

5. A signal multiplier according to claim 1 wherein said tuneable multiplier member comprises:

a variable current source in current pathway communication with (1) said output of said first amplifier member, and (2) said output of said second amplifier member.

6. A signal multiplier according to claim 1 wherein said first amplifier includes at least two stages of transistors in an emitter-follower configuration.

7. A signal multiplier according to claim 1 wherein said second amplifier includes at least two states of transistors in an emitter-follower configuration.

8. A signal multiplier according to claim 1 wherein:

said first current is proportionate to said first analog attribute; and said second current is proportionate to said second analog attribute.

9. A signal multiplier according to claim 1 wherein said means for maintaining comprises:

means for maintaining substantially linear response of said signal multiplier by cancellation of base currents in said first and second amplifier members.

10. A method of multiplying an analog differential signal defined by a first analog attribute and second analog atribute, comprising:

providing a first current corresponding to said first analog attribute;

providing a second current corresponding to said second analog attribute;

amplifying said first current by a predetermined multiple;

amplifying said second current by a predetermined multiple;

determining said multiple over a predetermined range of multiples; and maintaining a substantially linear and substantially amplified response over said predetermined range of multiples.

11. A method according to claim 10 wherein said step of maintaining a substantially linear response comprises:

maintaining a substantially linear response of said signal multiplier of at least approximately two orders of magnitude in multiplication.

12. A method according to claim 10 wherein said step of providing a first current comprises:

providing a first current corresponding to a first voltage level.

13. A method according to claim 10 wherein said step of providing a second current comprises:

providing a second current corresponding to a second voltage level.

14. A method according to claim 10 wherein said step of determining comprises:

determining said multiple over said predetermined range of multiplier by providing a variable current source in current pathway communication with (1) an output of said first step of amplifying, and (2) an output of said second step of amplifying.

15. A method according to claim 10 wherein:

said first current is proportionate to said first analog attribute; and said second current is proportionate to said second analog attribute.

16. A method according to claim 10 wherein said step of maintaining comprises:

maintaining a substantially linear response of signal multiplier by cancellation of base currents in said first and second steps of amplifying.

* * * * *